United States Patent [19]

Atherton et al.

[11] Patent Number: 4,921,454

[45] Date of Patent: May 1, 1990

[54] CLUSTER BLOCK ASSEMBLY

[75] Inventors: Charles G. Atherton, Mechanicsburg; John C. Swartz, Harrisburg, both of Pa.

[73] Assignee: AMP Incorporated, Harrisburg, Pa.

[21] Appl. No.: 368,506

[22] Filed: Jun. 20, 1989

[51] Int. Cl.[5] ..... H01R 21/00

[52] U.S. Cl. ..... 439/685; 439/456; 439/686

[58] Field of Search ..... 439/682, 683, 684, 685, 439/686, 687, 688, 689, 690, 691, 456

[56] References Cited

U.S. PATENT DOCUMENTS

| | | | |
|---|---|---|---|
| 3,336,567 | 8/1967 | Coldren | 439/685 |
| 4,109,992 | 8/1978 | Hughes et al. | 439/685 X |
| 4,114,971 | 9/1978 | Heimbrock | 439/685 |

*Primary Examiner*—Neil Abrams
*Assistant Examiner*—Khiem Nguyen
*Attorney, Agent, or Firm*—Allan B. Osborne

[57] ABSTRACT

Components for use with a base member in forming a cluster block assembly. More particularly the components include a cover housing which receives the base member and has slot-access cavities for terminals, terminals positioned in the cavities for being attached to wires entering the assembly and receptacles for sliding receiving post terminals entering the cavities through the slots and a cap for covering the cover housing.

1 Claim, 6 Drawing Sheets

20
18a
18
18b
14a
14
28
14b
16
16a
32
32a
32b
32
32b
16b
10 - PRIOR ART

CLUSTER BLOCK ASSEMBLY

FIELD OF THE INVENTION

The invention disclosed herein relates to an assembly for use with compressor motors and which includes electrical terminals adapted to engage mating post terminals extending outwardly from the motor.

BACKGROUND OF THE INVENTION

Assemblies used herein before to bring power and provide ground to the electrical motor of a refrigeration compressor included several parts which were difficult and time-consuming to attached to the wire harness and to the pin header on the motor.

It is now proposed to provided cluster block assembly which is less expensive to make, includes fewer parts to reduce the labor needed to terminate the wires and assemble the assembly and which further fully protects all conductive terminals.

SUMMARY OF THE INVENTION

According to the invention, a cover housing, terminals and a cap are provided for use with a base member in building a cluster block assembly. The cover includes a front portion with slot accessed cavities and a rear portion in which the base section of the base member is latchingly received. The terminals are positioned in the cavities and include wire ferrules for attaching to the wires entering the assembly and receptacles in line with the slots for slidingly receiving post terminals. The cap covers the top of the cover housing and is latched thereto to insulatingly and environmentally protect the base member and terminals.

DESCRIPTION OF THE INVENTION

Figure 1:
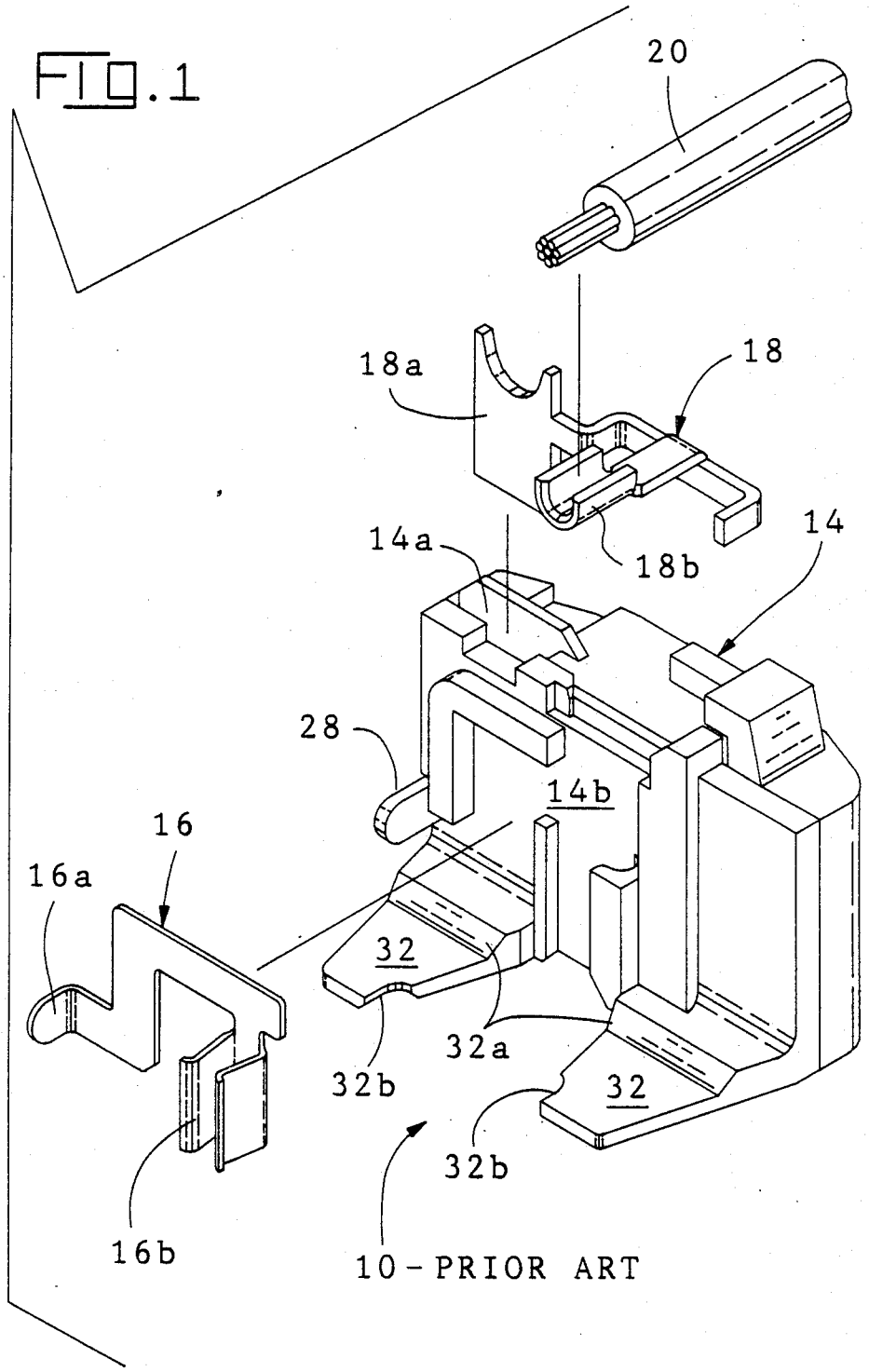
FIG. 1 is a perspective view of one component of the cluster block assembly and of the electrical terminals carried therein.

FIG. 1 shows prior art base member 10 which is part of the cluster block assembly 12 shown in FIGS. 4, 5, 6 and 7. Base member 10 includes base section 14 and feet 32 which are of a dielectric material, terminal 16 and terminal 18. Insulated wire 20 is shown above terminal 18 to which it attaches, terminal 18 includes plate **18*a* which is received in slot 14*a* in the top of section 14 and wire barrel 18*b* which rests on top of section 14 as shown in FIG. 2**.

Base section 14 is provided with grounding strap 28 which projects forwardly on one side thereof and which electrically engages plate **18*a* of terminal 18. Terminal 16, which is positioned on front face 14*b* of base section 14 between feet 32, includes ear 16*a* which is welded to strap 28. Terminal 16 also includes receptacle 16*b*** for receiving a grounding post terminal (not shown) on the compressor motor.

Feet 32 include a slanted surface **32*a* and concave notches 32*b*** adjacent the free ends.

Figure 2:
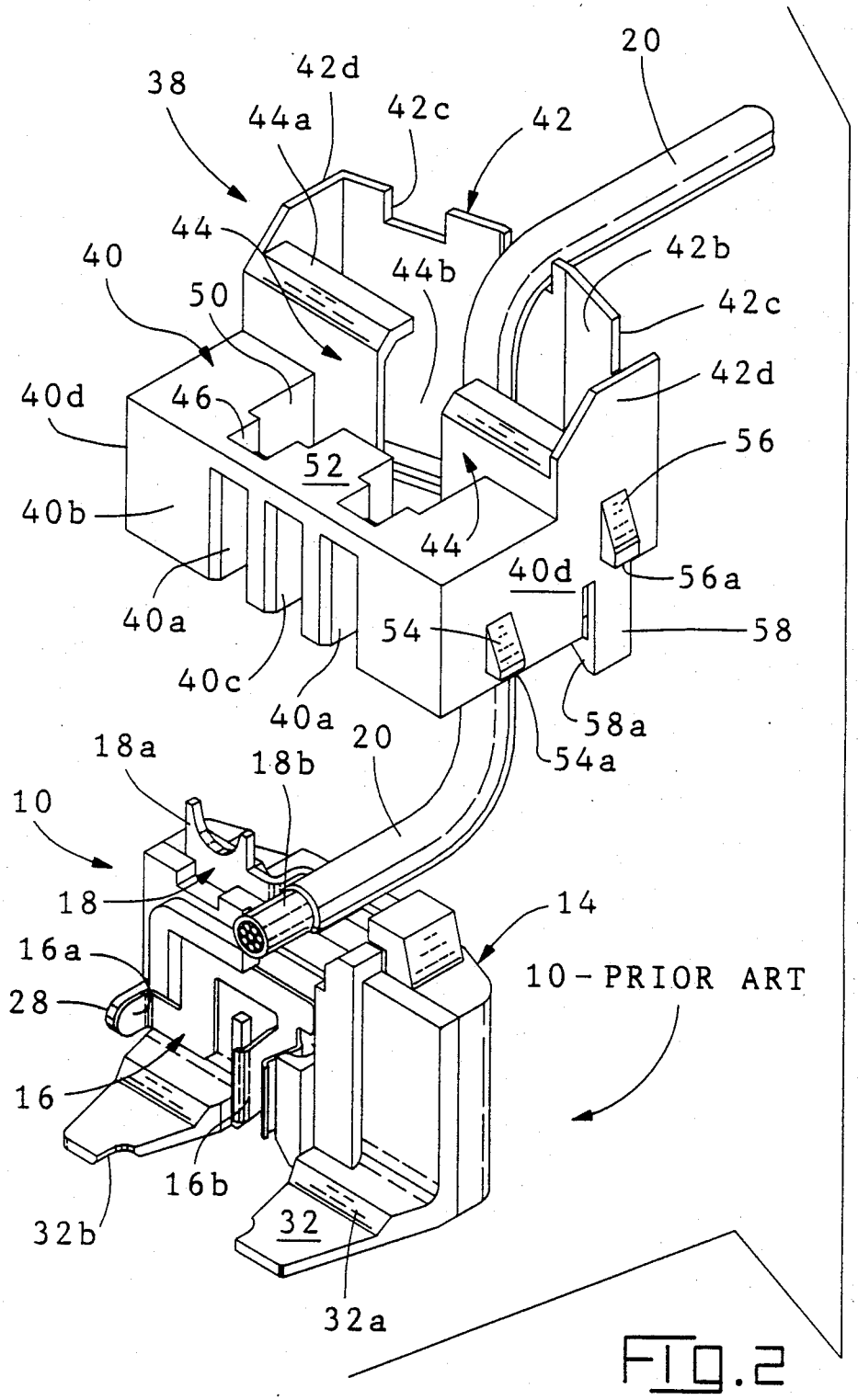
FIG. 2 is a perspective view showing the second component of the cluster block assembly along with the first and the start of the assembly thereof.
Figure 4:
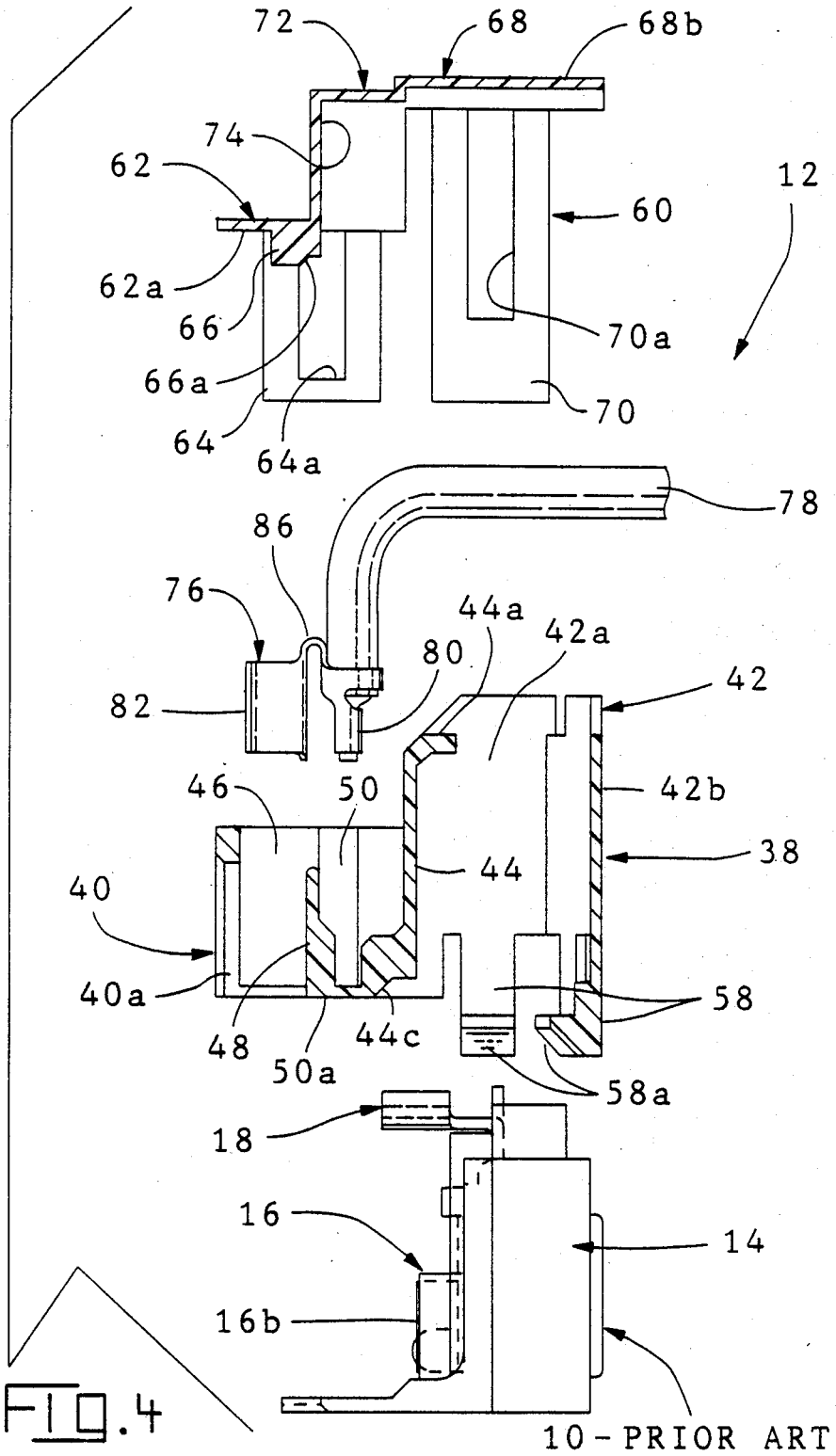
FIG. 4 is an exploded sectional views of the components in their order of assembly.

FIG. 2 shows member 10 with terminals 16, 18 fixed to base section 14 and wire 20 terminated in wire barrel **18*b*. Shown above member 10 is cover housing 38 through which wire 20 was threaded prior to being terminated. Cover housing 38, molded from a plastics material such as VALOX 420 SEO or VALOX 310 SEO, includes front portion 40 and rear portion 42 which are separated by center walls 44. Two outer slots 40*a* extend through the front face 40*b* of front portion 40 to intersect respective first cavities 46 as shown in FIG. 4. A short wall 48 separates first cavities 46 from second cavities 50. Cavities 46 are open downwardly and both cavities 46 and 50 are accessible from above. Center slot 40*c* extends through front face 40*b* and through shroud 52 which isolates slot 40*c* from cavities 46, 50. Shroud 52** is open from below.

Noses 54, providing downwardly facing shoulders **54*a*, are positioned on each side wall 40*d* of front portion 40**.

Center walls 44 include a bent-over top portion **44*a*. As shown in FIG. 2, space 44*b* separate the two walls 44. Further, walls 44 include bottom slanted surface 44*c* as shown in FIG. 4 which is a continuation of base surface 50*a* of cavities 50**.

Rear portion 42 includes an opening **42*a* extending vertically there through. Rear wall 42*b* is curved to generally reflect the curvature of the rear surface of base section 14. Notches 42*c* are provided in the top edge of wall 42*b* to provide passages for wires 20, 78 entering cluster block assembly 12**.

Noses 56, providing downwardly facing shoulders **56*a*, are positioned on each sidewall 42*d* of rear portion 42. Further, resilient latch fingers 58, having inwardly projecting hooks 58*a*, depend downwardly from the bottom edge of each sidewall 42*d* and from the bottom edge of rear wall 42*b***.

Figure 3:
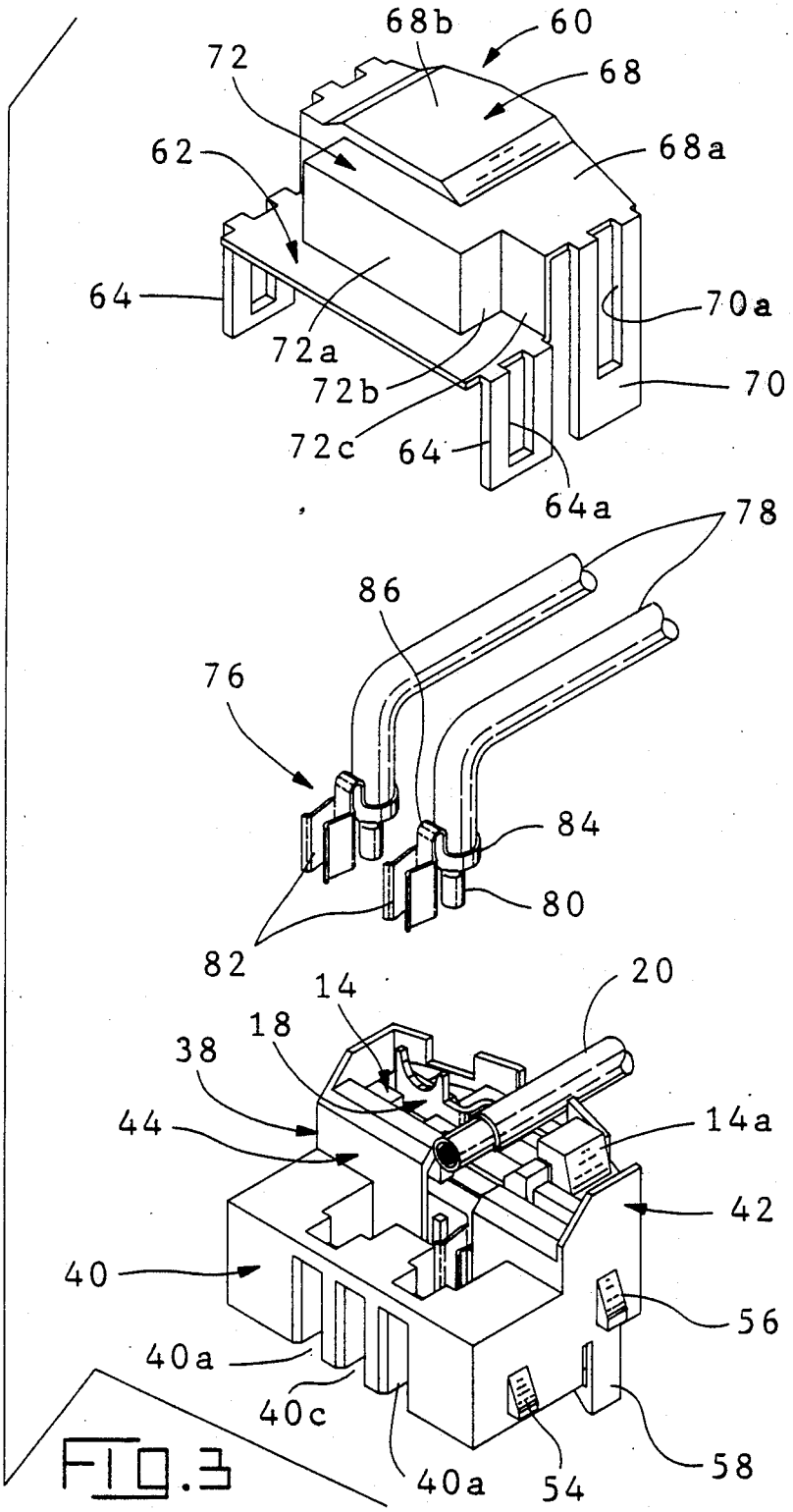
FIG. 3 is a perspective view showing the third component of the cluster block assembly along with the assembled first two components.

FIG. 3 shows cover housing 38 assembled to base member 10 and also cap 60, the third component of cluster block assembly 12, there above. Also shown are wires 78 terminated to terminals 76. As will be made more clear below, cover housing 38 slides down over housing 14 of member 10 with front portion 40 covering feet 32 and rear portion **42*a* receiving base section 14**.

Cap 60 includes a front section 62 with resilient latch arms 64 extending downwardly from each side. Elongated slots **64*a* are provided in each arm 64. As shown in FIG. 4, bar 66, extending across the downwardly facing surface 62*a* of front section 62, is provided with a downwardly curved recess 66*a***.

Rear section 68 of cap 60 includes first and second portions **68*a*, 68*b* with the latter being vertically offset from the former. Resilient latch arms 70 extend downwardly from each side of rear section 68 and are provided with elongated slots 70*a***.

Box-like intermediate section 72 of cap 60 includes the vertical walls **72*a*, 72*b* and 72*c* which define interior cavity 74 as shown in FIG. 4 and which also separates front and rear sections 62, 68** respectively.

FIG. 3 also shows terminals 76 which are secured to wires 78 by wire ferrules 80 being crimped onto the bared ends (not shown). Terminals 76 also include receptacles 82 which are parallel with wire barrel 80 and insulation supports 84 by reason of U-shaped straps 86.

FIG. 4 shows base member 10, cover housing 38 terminated wires 78 and cap 60 in one order of assembly. Wire 20, which is shown in FIG. 2, had been omitted so as not to obscure details of cover housing 38.

In one method of assembly, after threading wire 20 through opening 42*a* of cover housing 38, the bored end (not shown) is crimped in wire barrel 18*b* and cover housing 38 placed over member 10.

Figure 6:
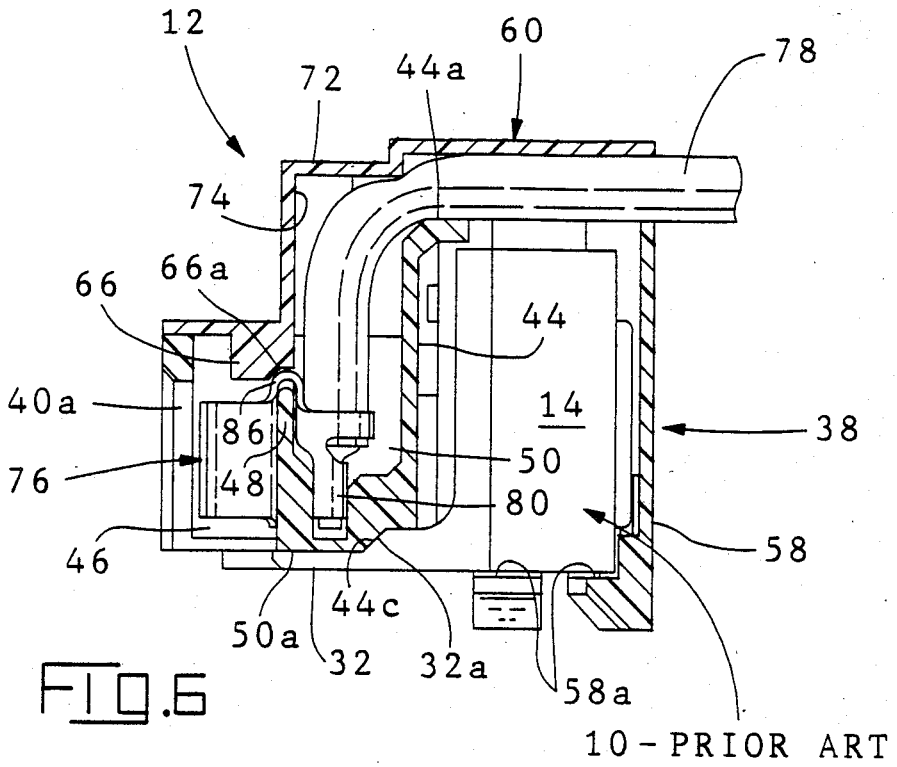
FIG. 6 is a sectional view of the assembled cluster block assembly taken along lines 6—6 of FIG. 5.

As shown in FIG. 6, the two components 10 and 38 are secured together by base surface 50*a* and slanted surface 44*c* abutting the tops of feet 32 and slanted surfaces 32*a* respectively and hooks 58*a* being received under base section 14.

Thereafter, terminals 76 (with wires 78 attached) are placed into front portion 40 of housing 38 with receptacles 82 being received in cavities 46 and wire barrels 80 being received in cavities 50. Support and stability is provided by U-shaped strap 86 abutting the top of dividing walls 48. Wires 78 are bent over curved top portions 44*a* of center walls 44 and through respective notches 42*c*.

The assembly is completed by placing cap 60 over cover housing 38 and securing it thereto by latch arms 64, 70 engaging noses 54, 56 respectively. Another method is to place cover housing over member 10 first and then terminate wire 20 to terminals 18.

Figure 5:
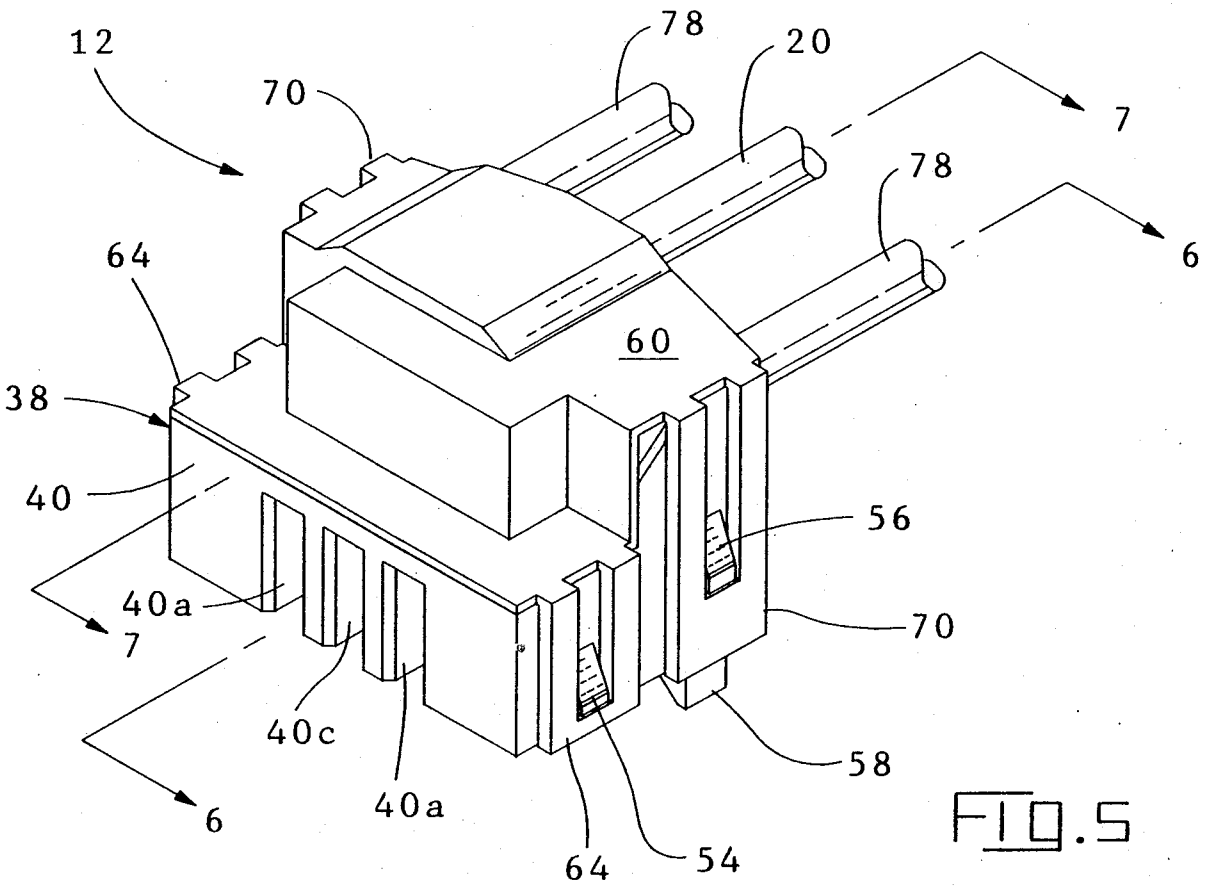
FIG. 5 is a perspective view showing the assembled cluster block assembly.

FIG. 5 shows the assembled cluster block assembly 12 and FIG. 6 shows assembly 12 in section. Of particular note is how terminals 76 are held in position by strap 86 being confined between wall 48 and recess 66*a*. Further, wires 78 are protected against pull-out by being perched between curved top portions 44*a* of center walls 44 and intermediate section 72 of cap 60.

Figure 7:
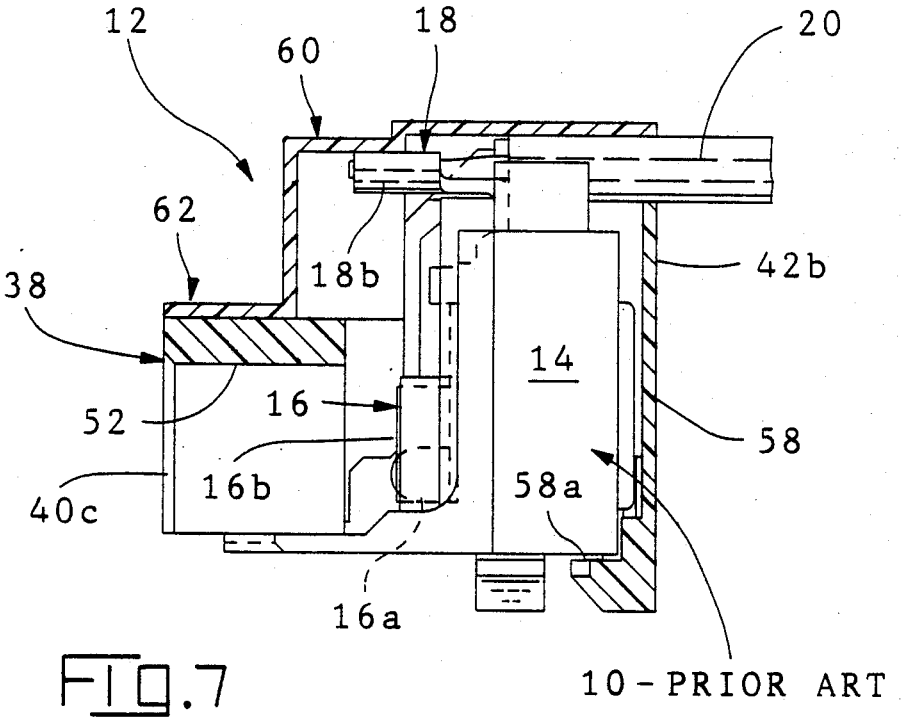
FIG. 7 is another sectional view of the assembled cluster block assembly taken along lines 7—7 of FIG. 5.

FIG. 7 is a sectional view taken from front to back of assembly 12 showing wire 20 terminated to terminal 18 and receptacle 16*b* of terminal 16 in line with shrouded slot 40*c*.

In use cluster block 12 may be slid onto the compressor motor (not shown) with electrical post terminals thereon (not shown) sliding through slots 40*a*, 40*c* and into respective receptacles 16*b* and 82.

As can be discerned, a cover housing, cap and terminals to cooperate with a base member in forming a cluster block assembly has been disclosed. The three components provide an assembly that fully protects the enclosed terminals and further is very readily attached and removed from a compressor motor. The cover housing includes slot-access cavities for receiving two terminals, an opening for receiving the base member and latch fingers for holding the cover housing and base member together. The cap includes bi-level surfaces for protectively covering the housing cavities and opening in which the base member is positioned. Latch arms on the cap cooperate with shoulders on the cover housing to secure the two together.

We claim:

1. Components for use in a cluster block assembly of the type having a base member consisting of a base section and a pair of spaced apart feet extending forwardly therefrom, said components comprising:

a cover housing having a front portion and a rear portion with center walls there between, said front portion having a pair of spaced apart cavities and three parallel slots extending through a front face with two outer slots intersecting said cavities and the middle slot being shrouded from said outer slots, said rear portion having an opening extending vertically there through, said cover housing receiving a base member with a base section thereof being received in the vertical opening and spaced apart feet on the base member being beneath said front portion;

terminals disposed in said cavities in said front portion and having wire barrels for being attached to wires entering the cluster block assembly and receptacles facing said outer slots for slidingly receiving post terminals;

a cap covering said cover housing, said cap having a front section covering said front portion and a rear section covering said rear portion; and latch means securing said cap to said cover housing together.

* * * * *

UNITED STATES PATENT OFFICE

CERTIFICATE OF CORRECTION

Patent No. 4,921,454 Dated May 1, 1990

Inventor(s) Charles G. Atherton, Michael Scott Feher and John C. Swartz

It is certified that error appears in the above-identified patent and that said Letters Patent is hereby corrected as shown below:

Title page:

Please add Michael S. Feher as an inventor on the patent.

Signed and Sealed this

First Day of October, 1991

*Attest:*

HARRY F. MANBECK, JR.

*Attesting Officer*

*Commissioner of Patents and Trademarks*